US005834886A

United States Patent [19]

Jeong et al.

[11] Patent Number: 5,834,886

[45] Date of Patent: Nov. 10, 1998

[54] SHADOW MASK FRAME WITH A CURVED FLANGE

[75] Inventors: Kyoungsik Jeong, Kyungsangnam-do; Jungsoo Chang, Busan-si, both of Rep. of Korea

[73] Assignee: Samsung Display Devices Co., Ltd., Kyungki-do, Rep. of Korea

[21] Appl. No.: 688,997

[22] Filed: Aug. 1, 1996

[30] Foreign Application Priority Data

Dec. 21, 1995 [KR] Rep. of Korea ..... 95-45127

[51] Int. Cl.[6] ..... H01J 29/07; H01J 29/82

[52] U.S. Cl. ..... 313/402; 313/407

[58] Field of Search ..... 313/402, 407, 313/403, 408

[56] References Cited

U.S. PATENT DOCUMENTS 4,739,216 4/1988 Yamazaki et al. ..... 313/407

5,550,428 8/1996 Kume et al. ..... 313/402

*Primary Examiner*—Sandra L. O'Shea
*Assistant Examiner*—Joseph Williams
*Attorney, Agent, or Firm*—Christie, Parker & Hale, LLP

[57] ABSTRACT

A combination structure of the shadow mask and the mask frame is a combination structure including a shadow mask, being disposed inside a panel of a color cathode-ray tube and a mask frame, supporting the shadow mask. The combination structure is that the shadow mask is inserted in the mask frame so as to touch internally the skirt portion of the shadow mask on the flange portion, and then their contact portions are adhered to each other by welding process so as to serve to decrease the amount of doming together with miss-landing of electron beams, and to improve color purity of the screen when it is applied to a color cathode-ray tube. And the flange portion is curved from the welding point where the flange portion and the skirt portion are welded, toward the outer direction of the mask frame.

2 Claims, 2 Drawing Sheets

SHADOW MASK FRAME WITH A CURVED FLANGE

BACKGROUND

The present invention relates to a combination structure of a shadow mask and a mask frame for color cathode-ray tubes, which can prevent decrease of color purity by doming phenomena in accordance with thermal expansion by means of thermal expansion toward its horizontal direction when the shadow mask is thermally expanded.

Generally, a color cathode-ray tube includes a bulb integrating a panel, a funnel and a neck, an electron gun system mounted in the neck, and a screen having a plurality of three different phosphors arranged on the inside of the panel to produce the three primary colors red (R), green (G), and blue (B).

Also, a shadow mask having a color-sorting function is disposed in a fixed distance from the screen. The shadow mask is set up on the inner face of the panel of the color cathode-ray tube and it allows electron beams to be landed on a phosphor layer according to color separation of the beams emitted from an electron gun.

The shadow mask is associated with a mask frame to form a mask assembly, which is mounted by a spring on the inside of the panel.

FIG. 2 is an exploded perspective view and the reference numeral 1 indicates the shadow mask.

The shadow mask is a general shadow mask including a rectangular 1*a*, which is formed with apertures through which the electron beams pass; and a skirt portion, 1*b* which is vertically extended and formed from four directions of the rectangular plate portion. A bead 1*c* for supplementing intensity is formed around the border of the rectangular plate portion.

The reference numeral 3 indicates the mask frame on which the shadow mask is supported. Generally, the mask frame is shaped having an opening 3*a* formed on its inner portion and a flange portion 3*b* is stood erect around its border.

The shadow mask and the mask frame are combined in steps including the insertion of the shadow mask in the mask frame so as to touch internally the skirt portion of the shadow mask on the flange portion, and then their contact portions are adhered to each other by welding.

As illustrated in FIG. 3, their combined state is such that the shadow mask and the mask frame are combined by welding at the contact portions 5 so that the skirt portion 1*b* and the flange portion 3*b* touch each other.

It is widely known that the shadow mask is domed by R,G,B electron beams, which do not pass through apertures of the shadow mask when operating the prior color cathode-ray tube.

In the prior art, the method for anti-doming is to allow the shadow mask to expand toward its horizontal direction at doming so that the amount of doming of its vertical direction is decreased.

However, when illuminating the assembly of the shadow mask and the mask frame from this point of view, as illustrated in FIG. 3, the shadow mask is welded on the mask frame so that the whole skirt portion is closely adhered on the flange portion, namely, the upper end portion of the skirt is closely adhered on the upper end portion of the flange portion. Therefore, the shadow mask can not expand toward its horizontal direction when doming by heat of electron beams because the skirt portion is completely restrained on the flange portion.

Accordingly, the doming phenomena of the shadow mask is accelerated because it is expanded toward its vertical direction.

As a result, the color cathode-ray tubes, which have the above combination structure, keep having the problems caused by doming phenomena, namely, the problem that color purity is decreased by miss-landing of electron beams.

SUMMARY

The present invention is made in an effort to solve the problems of the prior art. Its goals are to provide a combination structure of a shadow mask and a mask frame for color cathode-ray tubes, which combines a shadow mask and a mask frame so as to expand thermally horizontal direction of the shadow mask when the shadow mask is domed out so that it can prevent decrease of color purity.

To realize the above object, the invention provides a combination structure of a shadow mask and a mask frame for color cathode-ray tubes in which the shadow mask is inserted in the mask frame so as to touch internally the skirt portion of the shadow mask on the flange portion, and then their contact portions are adhered to each other by a welding process.

In addition, the invention provides a combination structure of a shadow mask and a mask frame for color cathode-ray tubes in which the mask frame is formed by curving an upper side portion of a flange portion and the curving direction of the upper side portion looks toward the outer direction of the mask frame.

At this time, it is desirable to maintain 15°–30° for a vertical center line of the mask frame in its curving angle of the upper side portion.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

A preferred embodiment of the present invention will now be described in detail with reference to the accompanying drawings.

Figure 1:
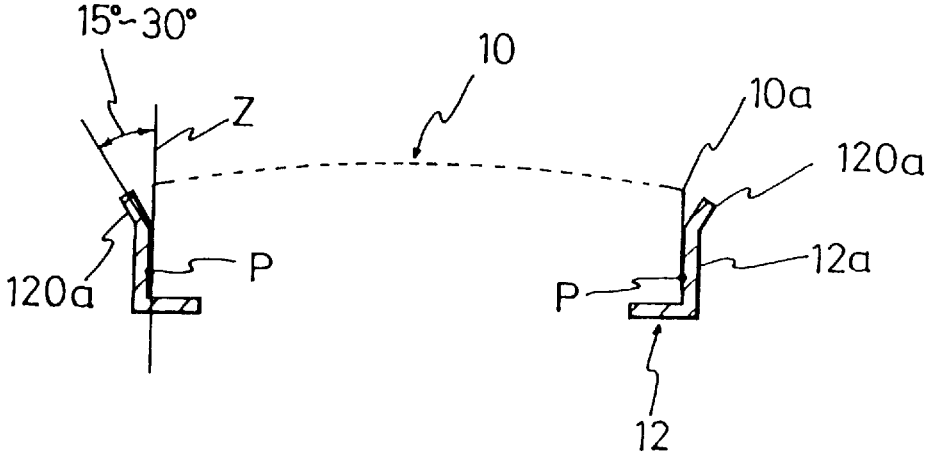
FIG. 1 is a cross sectional view illustrating a combination structure of a shadow mask and a mask frame for color cathode-ray tubes in accordance with a preferred embodiment of the invention.
Figure 3:
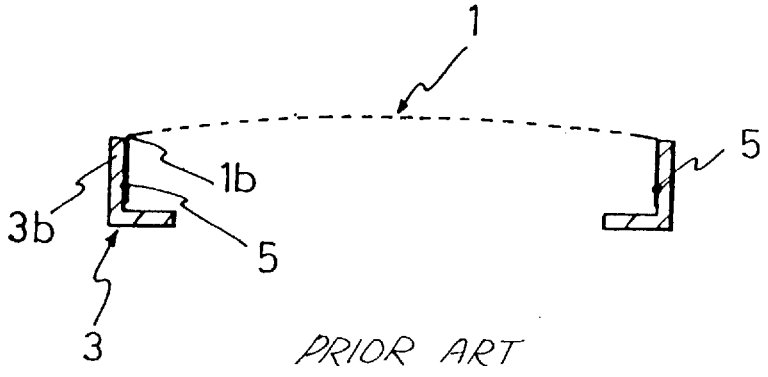
FIG. 3 is a cross sectional view illustrating a combination structure of a shadow mask and a mask frame for color cathode-ray tubes in accordance with a preferred prior embodiment.
Figure 2:
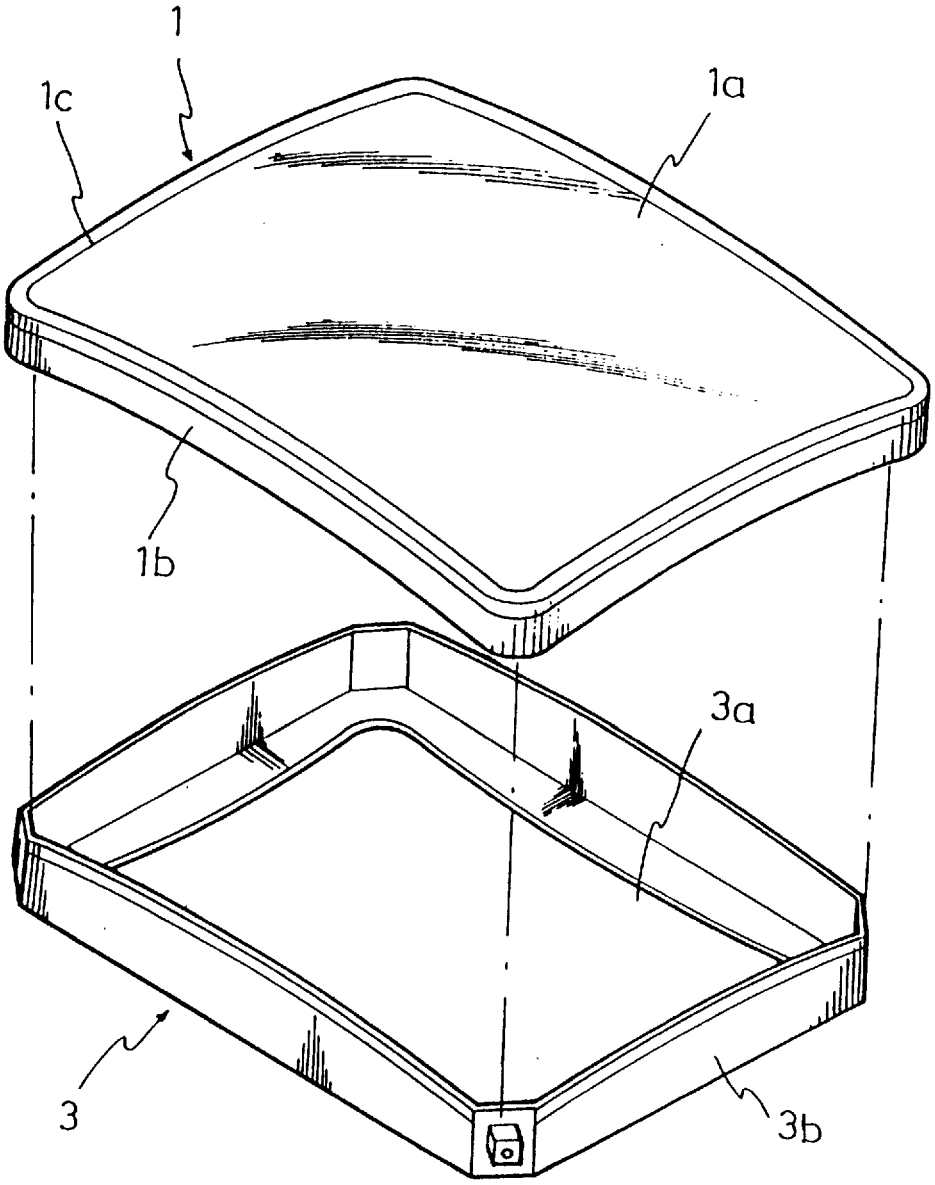
FIG. 2 is an exploded perspective view illustrating a combination state of a shadow mask and a mask frame for color cathode-ray tubes in accordance with a preferred embodiment of the invention.

FIG. 1 illustrates a cross sectional view of a combination structure of a shadow mask and a mask frame for color cathode-ray tubes in accordance with a preferred embodiment. The reference numerals 10 and 12 respectively indicate a shadow mask and a mask frame.

The above whole shape of the shadow mask 10 and the mask frame 12 is identical to that of the prior art. Therefore, the rest is omitted.

However, the mask frame 12 is formed by curving an upper side portion 120*a* of a flange portion 12*a*.

At this time, the curving direction of the upper side portion 120*a* is toward the outer direction of the mask frame 12 and it is desirable to maintain 15°–30° for a vertical center line Z of the mask frame 12 in its curving angle.

The criterion that determines the upper portion 120*a* from the flange portion 12*a* is a welding point P of the shadow mask.

Namely, the flange portion 12*a*, which is applicable to the upper portion of the welding point is curved in the present invention, when forming the mask frame 12.

The shadow mask 10 is inserted in the mask frame 12, which is formed like the above in order that the outer side face of the skirt portion 10*a* may be adhered on the inner side face of the flange portion 12*a* like the prior art. Then, the welding point P is welded by a welding process, accordingly, the shadow mask and the mask frame are combined.

As understood in Figs, the shadow mask 10 is inserted so that the lower part of the skirt portion 10*a* is placed in the center of the flange portion 12*a*. And the welding point P is determined by the part which the skirt portion 10*a* and the flange portion 12*a* are closely adhered to each other.

If the assembly which the shadow mask 10 and the mask frame 12 are combined to each other are applied to the color cathode-ray tube, the shadow mask 10 is domed out by electron beams in the same manner as the prior art.

However, because the upper part of the skirt portion 10*a* is not adhered on the flange portion 12*a* in the above structure, the upper part of the skirt portion 10*a* can be moved as usual without being restrained by the flange portion 12*a*.

Accordingly, the shadow mask 10 can be thermally expanded toward a horizontal direction (the direction of the arrow in Figs.) when doming. And, according to this thermal expansion toward a horizontal direction, the amount of vertical thermal expansion is greatly reduced compared to the prior art.

Namely, the invention decreases the total amount of doming by dispersing thermal expansion of the vertical direction of the shadow mask 10 toward the horizontal direction.

In view of the results so far achieved by experiments, when the assembly of the shadow mask and the mask frame according to the invention is applied to the color cathode-ray tube, it is proved that the assembly can decrease the amount of doming by about 20% more than the prior assembly.

As described in the above, the combination structure of the shadow mask and the mask frame according to the invention can be thermally expanded toward the horizontal direction of the shadow mask as well as the vertical direction when the shadow mask is domed out.

Accordingly, the invention can serve to decrease the amount of doming together with miss-landing of electron beams, and to improve color purity of the screen.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A combination structure for a color cathode-ray tube, comprising:

a shadow mask having a skirt portion; and a mask frame having a flange portion with a rear portion substantially parallel to the skirt portion, said rear portion being adhered to a portion of the skirt portion, and a front portion curved in a direction away from the shadow mask.

2. The combination structure of claim 1 wherein the curved front portion of the flange portion has an angle substantially between 15°–30° from a line extending through the rear portion of the flange portion.

* * * * *